US012534982B2

(12) United States Patent
Loh et al.

(10) Patent No.: US 12,534,982 B2
(45) Date of Patent: Jan. 27, 2026

(54) TWO-STAGE EXPANDABLE LINER HANGER

(71) Applicant: Halliburton Energy Services, Inc., Houston, TX (US)

(72) Inventors: Chee Sing Kelvin Loh, Singapore (SG); Shanu Thottungal Eldho, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/977,360

(22) Filed: Dec. 11, 2024

(65) Prior Publication Data

US 2025/0109666 A1 Apr. 3, 2025

Related U.S. Application Data

(62) Division of application No. 17/983,986, filed on Nov. 9, 2022, now Pat. No. 12,203,349.

(51) Int. Cl.

| | |
|---|---|
| ***E21B 43/10*** | (2006.01) |
| ***E21B 23/01*** | (2006.01) |
| ***E21B 33/12*** | (2006.01) |

(52) U.S. Cl.

CPC ..... *E21B 43/103* (2013.01); *E21B 23/01* (2013.01); *E21B 33/1212* (2013.01)

(58) Field of Classification Search

CPC .... E21B 43/103; E21B 23/01; E21B 33/1212; E21B 29/005; E21B 33/0422; E21B 33/146; E21B 23/00; E21B 43/105

See application file for complete search history.

(56) References Cited

U.S. PATENT DOCUMENTS

| | | | | |
|---|---|---|---|---|
| 7,104,322 | B2 | 9/2006 | Whanger et al. | |
| 7,571,774 | B2 * | 8/2009 | Shuster | E21B 43/105 166/384 |
| 7,591,320 | B2 | 9/2009 | Phipps | |
| 9,752,400 | B2 | 9/2017 | Hazelip et al. | |
| 10,196,870 | B2 | 2/2019 | Eldho et al. | |
| 11,352,858 | B2 * | 6/2022 | Connor | E21B 43/105 |
| 12,203,349 | B2 * | 1/2025 | Loh | E21B 23/01 |
| 2003/0106698 | A1 | 6/2003 | Simpson et al. | |
| 2003/0178204 | A1 | 9/2003 | Echols et al. | |
| 2004/0256098 | A1 | 12/2004 | Ducasse et al. | |

(Continued)

FOREIGN PATENT DOCUMENTS

| | | |
|---|---|---|
| EP | 2675991 | 6/2020 |

OTHER PUBLICATIONS

International Search Report and Written Opinion for International Patent Application No. PCT/US2022/051414 dated Jul. 26, 2023.

(Continued)

*Primary Examiner* — Yong-Suk (Philip) Ro

(74) *Attorney, Agent, or Firm* — Scott Richardson; C. Tumey Law Group PLLC

(57) ABSTRACT

A method for expanding a two-stage expandable liner hanger includes expanding a first section of an expandable tubular having the first section and a second section. The first section includes one or more anchoring ribs. The method further includes expanding the second section of the expandable tubular after cement is pumped into the expandable tubular.

17 Claims, 14 Drawing Sheets

(56) References Cited

U.S. PATENT DOCUMENTS

| | | | | |
|---|---|---|---|---|
| 2005/0236162 | A1 | 10/2005 | Badrak et al. | |
| 2006/0065403 | A1* | 3/2006 | Watson | E21B 43/103 166/207 |
| 2006/0102360 | A1* | 5/2006 | Brisco | E21B 43/105 166/207 |
| 2006/0124295 | A1 | 6/2006 | Maguire | |
| 2006/0272827 | A1 | 12/2006 | Adam et al. | |
| 2017/0145778 | A1 | 5/2017 | Zijsling et al. | |
| 2019/0316448 | A1 | 10/2019 | Connor et al. | |
| 2020/0370383 | A1 | 11/2020 | Hazelip | |

OTHER PUBLICATIONS

Office Action Summary for U.S. Appl. No. 17/983,986 dated Sep. 28, 2023.

* cited by examiner

TWO-STAGE EXPANDABLE LINER HANGER

CROSS-REFERENCE TO RELATED APPLICATIONS

The present application is a divisional of U.S. patent application Ser. No. 17/983,986, filed Nov. 9, 2022, the entire disclosure of which is incorporated herein by reference.

BACKGROUND

Expandable liner hangers ("ELH") may generally be used to secure a liner within a previously installed casing, tubular, or other conduit. ELH may be set by expanding the liner hanger radially outward to grip and seal against the casing. For example, ELH may be expanded by a setting tool to drive an expanding cone, wedge, or pig, through the liner hanger. Other methods may be used, such as mechanical swaging, explosive expansion, memory metal expansion, swellable material expansion, and/or electromagnetic force-driven expansion, for example.

ELH may be cemented or uncemented. Typically, the hanger may be anchored in place before a running tool is partially retrieved for cementing. After cementing, the hanger is set. The liner hanger may be at least partly engaged with the wellbore structure prior to pumping the cement downhole. However, achieving cement coverage across the length of an expandable liner hanger may prove to be a challenge with the currently technology.

BRIEF DESCRIPTION OF THE DRAWINGS

These drawings illustrate certain aspects of some of the present disclosure, and should not be used to limit or define the disclosure.

DETAILED DESCRIPTION

Figure 1A:
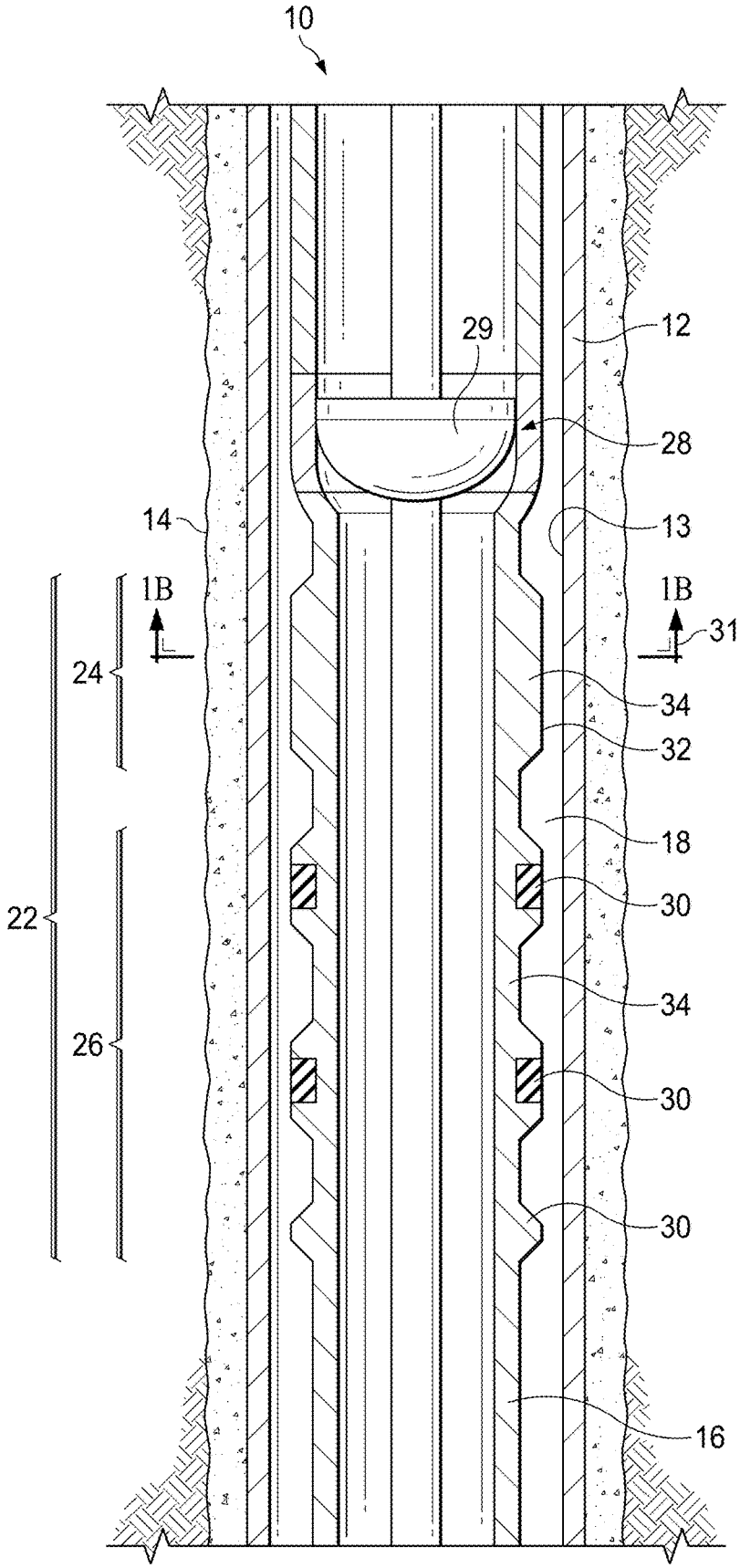
FIGS. 1A and 1B illustrates a liner hanger setting system.

The present disclosure relates to a two-stage expandable liner hanger that includes two independently expandable tubular portions with different configurations of engagement members for engaging a casing or wellbore. The expandable portions may be coupled end to end and disposed one above the other in a wellbore and may be referred to interchangeably in any of the various examples as first and second portions, top and bottom portions, upper and lower portions, and so forth, respectively. In an example, a top portion includes one or more engagement members which may further include any of a variety of anchoring member configurations discussed below (e.g., vertical or helical anchoring ribs), either continuous or segmented, aligned or offset. These anchoring members provide for anchoring the liner hanger to the casing by biting engagement with the casing in response to expansion of the hanger, while radially spacing the casing from the liner hanger sufficiently to allow cement to pass between the liner hanger and casing. A bottom portion (i.e., lower portion or bottom portion) is also expandable, and includes another type of engagement member referred to as gripping and/or scaling member(s). These gripping and/or sealing members may frictionally engage the casing to provide grip, and may also provide a seal, such as metal to metal ("MTM") seal with the casing after expansion.

A running tool may be assembled with the two-stage expandable hanger, creating a hanger system. Once the system reaches a setting depth, the running tool expands the first portion (e.g., the top portion) of the liner hanger to push anchoring members (e.g., anchoring ribs) of the hanger outward, thereby anchoring the hanger onto the inner diameter ("ID") of the casing. The running tool may then be released from the hanger and cementing the liner may begin. With the benefit of the anchoring ribs disposed on the expanded first portion, the cement may flow through the space between the ribs, ensuring that the cement has passed from the bottom of the liner to the top of the hanger. Once the cementing is done the running tool is reengaged into the hanger. The running tool then expands the remaining portion of the hanger, completing the installation of the two-stage liner hanger.

Other examples may include fluid passageways through a wall of the liner hanger and disposed between the first portion and the remaining portion of the expandable body of the hanger. In further examples, the fluid passageways may be disposed in the middle of the expandable body of the hanger. The running tool may be installed in the hanger and may expand the top portion to engage the anchoring members disposed above the fluid passageways against the casing. Once the cone (running tool) reaches the fluid passageways of the hanger, the expansion stops, thereby preserving fluid communication through the fluid passageways, and the running tool is retrieved. Cement may then be pumped down the liner (e.g., with a slickjoint and packoff) and back to the hanger top via the fluid passageways, allowing complete cementing of the whole liner. Once cementing is done, the remaining portion of the hanger is expanded.

The techniques as described herein may be directed to cemented liner applications which utilize axial load bearing assemblies in conjunction with an expandable liner hanger. In some examples, the configuration of the load bearing assemblies in relation to the expandable liner hanger may allow for intrusion of cement into the annular space of one or more load bearing assemblies. In further examples, the one or more load bearing assemblies may maintain an annular conduit for cement flow-through while expanded to engage with a casing or wellbore. Other examples include independently gripping and sealing the liner hanger (expanded) against a casing or wellbore wall while allowing for cement coverage across the length of the expandable liner hanger. Some configurations may include gripping and scaling engagement between telescoped tubulars while allowing for cement passage.

FIG. 1A illustrates an expandable liner hanger system 10 in accordance with examples of the present disclosure. The description is provided with reference to a vertical wellbore; however, the embodiments disclosed herein can be used in horizontal, vertical or deviated wellbores. In the system 10, a casing string 12 has been installed and cemented within a wellbore 14. A liner 16 is to be hung, extending downhole from a lower end of the casing string 12. A liner assembly, which may be relayed into wellbore 14 using a work string 20, may include at least a liner hanger assembly 22 and liner 16. When the liner assembly is disposed in wellbore 14, but before the hanger is engaged, there exists an annulus 18 between casing string 12 and liner 16, casing string 12 and work string 20, and casing string 12 and liner hanger assembly 22. Liner hanger assembly 22 includes at least an upper section of the liner hanger assembly 24 and a lower section of the liner hanger assembly 26. Liner hanger assembly 22 may further include a section that extends above upper section 24, a section that extends between upper section 24 and lower section 26, and a section that extends below lower section 26. In some examples, liner 16 may extend below lower section 26 or may extend below the section that extends below lower section 26. Liner hanger assembly 22 can support additional wellbore casing, operational tubulars or tubing strings, completion strings, downhole tools, etc., for positioning at greater depths.

As used herein, the terms "liner," "casing," and "tubular" are used generally to describe tubular wellbore items, used for various purposes in wellbore operations. Liners, casings, and tubulars can be made from various materials (metal, plastic, composite, etc.), can be expanded or unexpanded as part of an installation procedure, and can be segmented or continuous. It is not necessary for a liner or casing to be cemented into position. Any type of liner, casing, or tubular may be used in keeping with the principles of the present disclosure.

As depicted in FIG. 1A, liner hanger 22 is used to seal and secure an upper end of liner 16 near a lower end of the casing string 12. Alternatively, liner hanger assembly 22 could be used to seal and secure the upper end of liner 16 above a window (not shown) formed through a sidewall of casing string 12, with the liner extending outwardly through the window into a branch or lateral wellbore. Thus, it will be appreciated that many different configurations and relative positions of the casing string 12 and liner 16 are possible in keeping with the principles of the disclosure.

A setting tool 28 is disposed proximate liner hanger assembly 22 on work string 20. In some examples, setting tool 28 may include an expansion cone 29. Work string 20 may be used to convey setting tool 28, liner hanger assembly 22, and liner 16 into wellbore 14. Work string 20 may further be used to conduct fluid pressure and flow, transmit torque, tensile and compressive force, etc. Setting tool 28 is used to facilitate conveyance and installation of the liner 16 and liner hanger assembly 22, in part by using the torque, tensile, and compressive forces, fluid pressure and flow, as delivered by work string 20.

The liner hanger assembly 22 is shown with generic gripping and/or sealing members 30 positioned on and attached to the liner hanger 22. These gripping and/or sealing members 30 may comprise, for example, an elastomeric sealing element or a metallic region capable of metal-to-metal sealing contact with the casing when expanded. In some examples, one or more gripping and/or sealing members 30 may be disposed on the exterior surface of lower section 26 of liner hanger assembly 22.

Figure 1B:
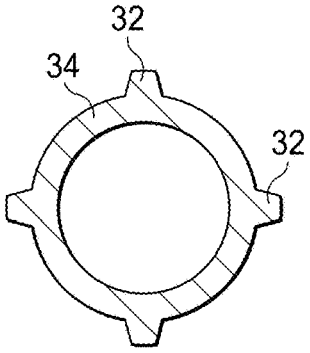

With additional reference to FIG. 1B (a cross sectional view 31 of FIG. 1A), the upper section 24 of liner hanger assembly 22 includes one or more anchoring members, embodied in this example as anchoring ribs 32, which may be disposed on the exterior surface of liner hanger assembly 22. As depicted in FIG. 1A, anchoring ribs 32 may include extrusions on the exterior surface of liner hanger which project radially outwardly and extend continuously or segmented along at least a portion of upper section 24 of liner hanger assembly 22. The length of anchoring ribs 32 along the exterior longitudinal surface of liner hanger assembly 22, as well as the width and spacing of anchoring ribs 32 around the exterior circumference of liner hanger assembly 22, may vary according to application. In some examples, anchoring ribs 32 may be spaced circumferentially around the exterior surface of upper section 24 of liner hanger assembly 22. As will be discussed below, various spacing schemes may be employed to orient and place anchoring ribs 32 on the exterior surface of linger hanger assembly 22.

The tubular body of upper section 24 of liner hanger assembly 22 may be an expandable tubular 34. Anchoring ribs 32 may be compacted or engaged into the interior surface of casing string 12 as the extrusion cone 29 of setting tool 28 is progressed along the length of upper section 24 of liner hanger assembly 22. In such examples, anchoring ribs 32 may anchor upper section 24 of liner hanger assembly 22 into the interior surface of casing string 12. As previously mentioned, anchoring ribs 32 may engage with the inner surface of a tubular disposed in wellbore 14 (for example, the interior surface of casing string 12) by biting engagement. The method of engaging gripping and/or sealing members 30 may be similar to the method of engaging anchoring members such as anchoring ribs 32 in terms of expanding the respective portion of the expandable tubular to bring into engagement with the casing. However, the way sealing and/or gripping members engage with the interior surface of casing string 12 may be different. For example, anchoring members may bite into the casing in response to expansion, plastically deforming the material of the casing at the location of contact, and may be axially and/or circumferentially spaced. By contrast, sealing and/or gripping members may frictionally engage the casing, and may form a continuous, i.e., 360-degree circumferential/annular seal with the casing. In some examples anchoring ribs 32 and gripping and/or sealing members 30 may differ in their anchoring pattern and construction materials. When lower section 26 of liner hanger assembly 22 is expanded, such as with an expansion cone 29 of setting tool 28, into gripping, sealing, and/or anchoring engagement with the casing, the external gripping and sealing members 24 sealing, grippingly, and/or anchoringly engage the interior of the casing string 12. These elements are discussed more fully below.

Figure 2A:
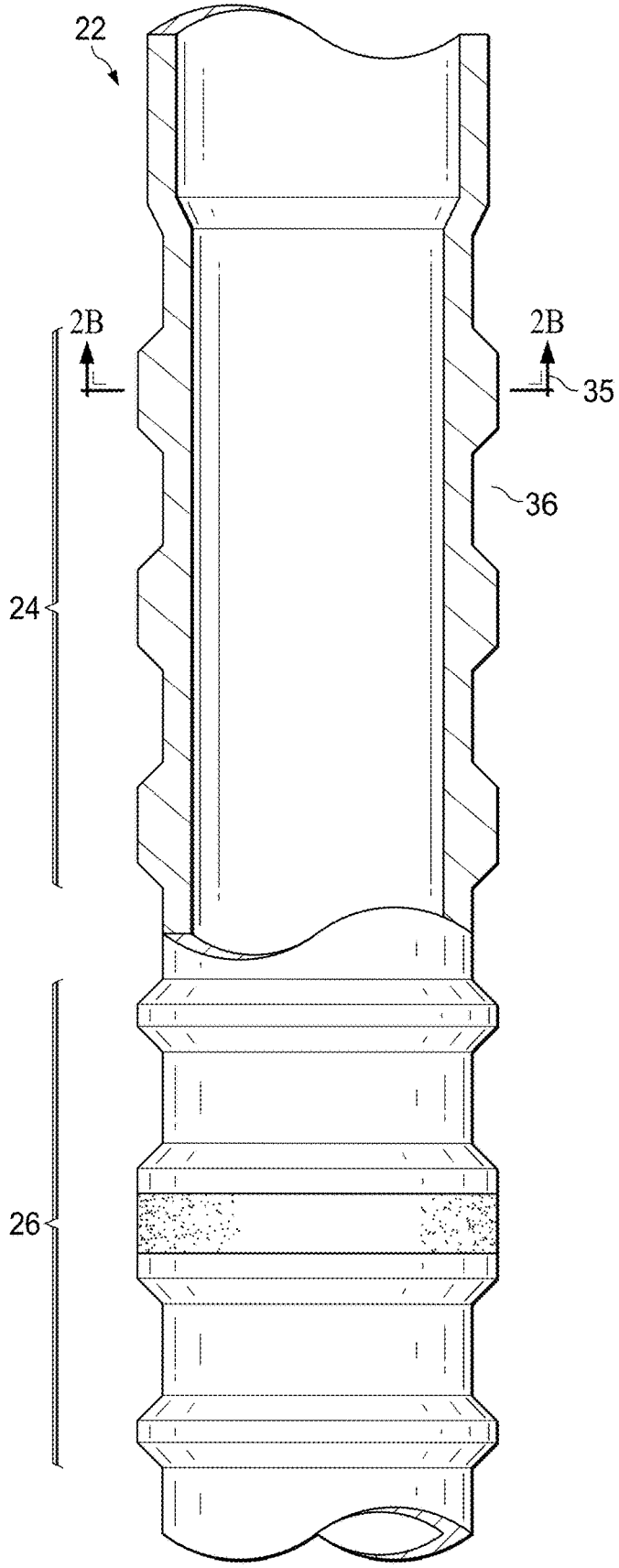
FIGS. 2A-2E illustrates exemplary gripping members for an upper section of a liner hanger setting system.
Figure 2B:
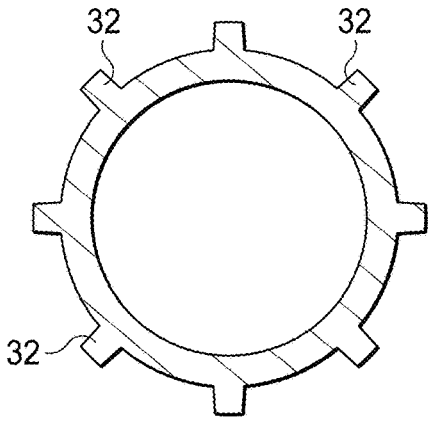
Figure 2C:
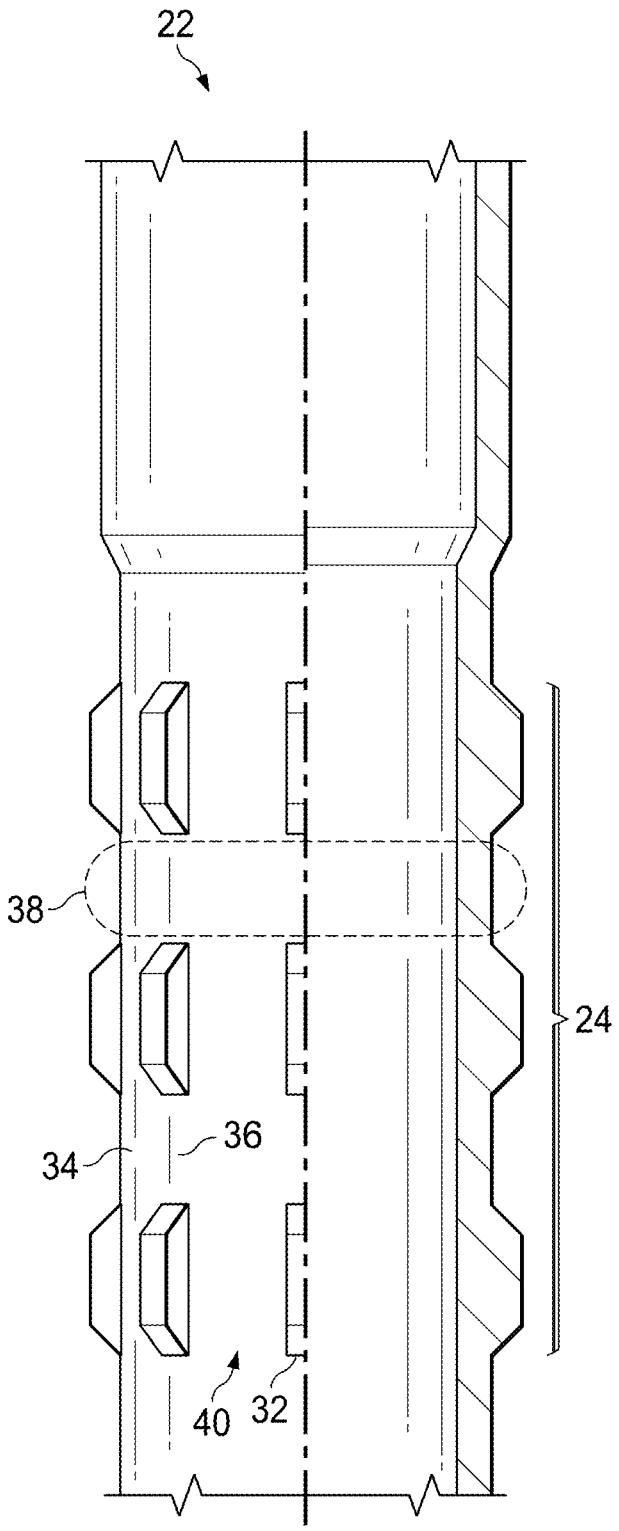

FIG. 2A-2C display different view of upper section 24 of liner hanger assembly 22, where anchoring ribs 32 have the same anchoring pattern. FIG. 2A depicts an example of liner hanger assembly 22 with an exposed longitudinal cross section of upper section 24. As depicted, anchoring ribs 32 of FIG. 2A are broken into segments along the longitudinal length of upper section 24 of liner hanger assembly 22. FIG. 2B, a cross-sectional 35 view of FIG. 2A, displays eight anchoring ribs 32 spaced equidistant in the circumferential direction of upper section 24 of liner hanger assembly 22. In some examples, the layout of anchoring ribs 32 of FIG. 2A and FIG. 2C may be described as "castellated," in that, the anchoring ribs 32 are segmented, and the resulting segments are axially separated to define grooves 36 therebetween which may be patterned intermittently along the longitudinal length of upper section 24 of liner hanger assembly 22. In FIG. 2C, for example, anchoring ribs 32 and grooves 36 are disposed on expandable tubular 34 and are respectively aligned in the circumferential direction (e.g., along the circumference) such that the grooves 36 are located between anchoring ribs 32 in the longitudinal direction. Grooves 36 form continuous grooved sections, or rings 38, in the circumferential direction on expandable tubular 34. In further examples, rings 38 are parallel to the transverse plane of expandable tubular 34 which makes up the body of liner hanger assembly 22. In some examples, grooves 36 which run both longitudinally to form longitudinal groove 40 and circumferentially along upper section 24 of liner hanger assembly 22, may provide a flow conduit for cementing operations. The number and spacing of anchoring ribs 32 in the circumferential direction of upper section 24 of liner hanger assembly 22 may vary. For example, while FIG. 2B, a cross-sectional view of FIG. 2A, displays eight anchoring ribs 32 spaced equidistant in the circumferential direction of liner hanger assembly 22, other counts and arrangements of anchoring ribs 32 will be apparent to those of skill in the art.

Figure 2D:
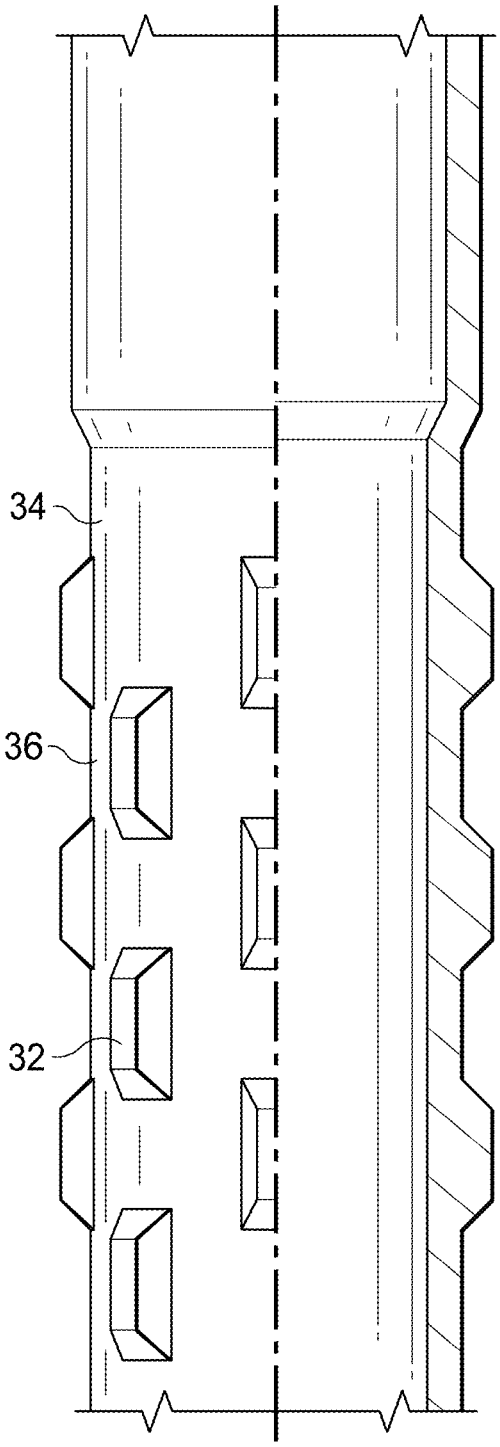
Figure 2E:
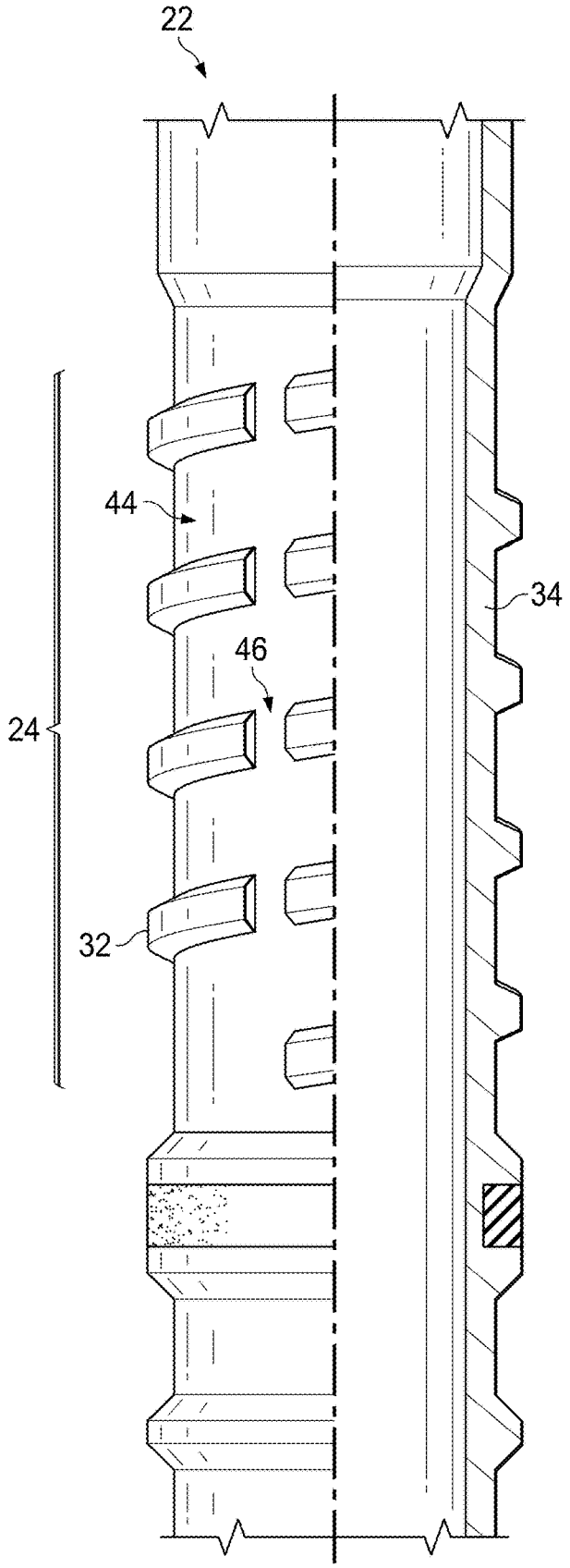

FIG. 2D depicts what may described as a "staggered castellated," anchoring pattern. In comparison to the castellated anchoring pattern, anchoring ribs 32 and grooves 36 of the staggered castellated anchoring pattern are disposed on expandable tubular 34 such that they are longitudinally translated relative to the location of the longitudinal set of anchoring ribs 32 in the lateral direction. In some examples, the pattern of anchoring ribs 32 may be disposed on expandable tubular 34 in a spiral or helical shape as depicted in FIG. 2E. For example, the pathway of grooved section 44 of FIG. 2E may be aligned at any angle other than parallel to the transverse plane of liner hanger assembly 22. In further examples, there may be a groove 46 which runs parallel to the longitudinal axis of liner hanger assembly 22. In some examples, groove 46 may be staggered or translated in the circumferential direction such that it does not create a continuous flow path in the longitudinal direction. With respect to FIGS. 2A-2E, in some examples anchoring ribs 32 may be a subassembly of the expandable tubular which makes up part of the structure of upper section 24 of liner hanger assembly 22. In some examples, anchoring ribs 32 may be integrally molded with the expandable tubular. In other examples, anchoring ribs 32 may be molded or directly machined. In further examples, anchoring ribs 32 may be created by additive manufacturing.

Figure 3:
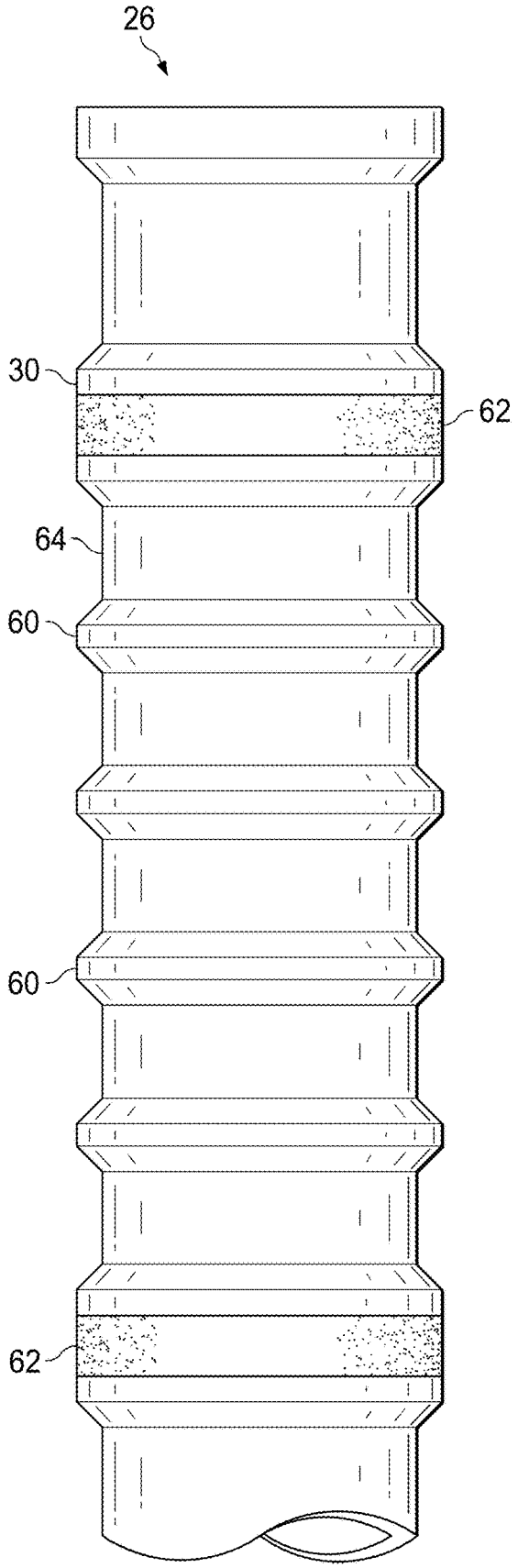
FIG. 3 illustrates exemplary gripping and sealing members for a lower section of a liner hanger setting system.

FIG. 3 depicts lower section 26 of the liner hanger assembly (e.g., liner hanger assembly 22 in FIG. 1). In some examples, lower section 26 of the liner hanger assembly may include one or more gripping and/or scaling members (e.g., gripping and/or sealing members 30 in FIG. 1). In some examples, and as shown in FIG. 3, the gripping and/or sealing members may include anchoring ridges 60 and/or scaling members 62. In some examples, scaling members 62 may be elastomeric or may include a bonded elastomeric material. Anchoring ridges 60 and/or scaling members 62 may be disposed on an expandable tubular 64. When expanded, anchoring ridges 60 may create a metal-to-metal seal against the inner surface of a wellbore casing, wellbore tubular, or wellbore liner. In some examples, anchoring ridges 60 may provide improved scaling performance at elevated temperatures. Additionally, anchoring ridges 60 and/or sealing members 62 may be sub-assemblies of expandable tubular 64 such that the inner diameters of anchoring ridges 60 and/or sealing members 62 may abut the outer diameter of expandable tubular 64. While FIG. 3 may depict four anchoring ridges 60 disposed between two sealing members 62, there may be any number of anchoring ridges 60 spaced between sealing members 62. Furthermore, anchoring ridges 60 need not be spaced equidistant within the space between sealing members 62. Across the longitudinal length of lower section 26 of the liner hanger assembly, there may be any number, organization, configuration, or spacing of scaling members 62 and anchoring ridges 60.

Figure 4A:
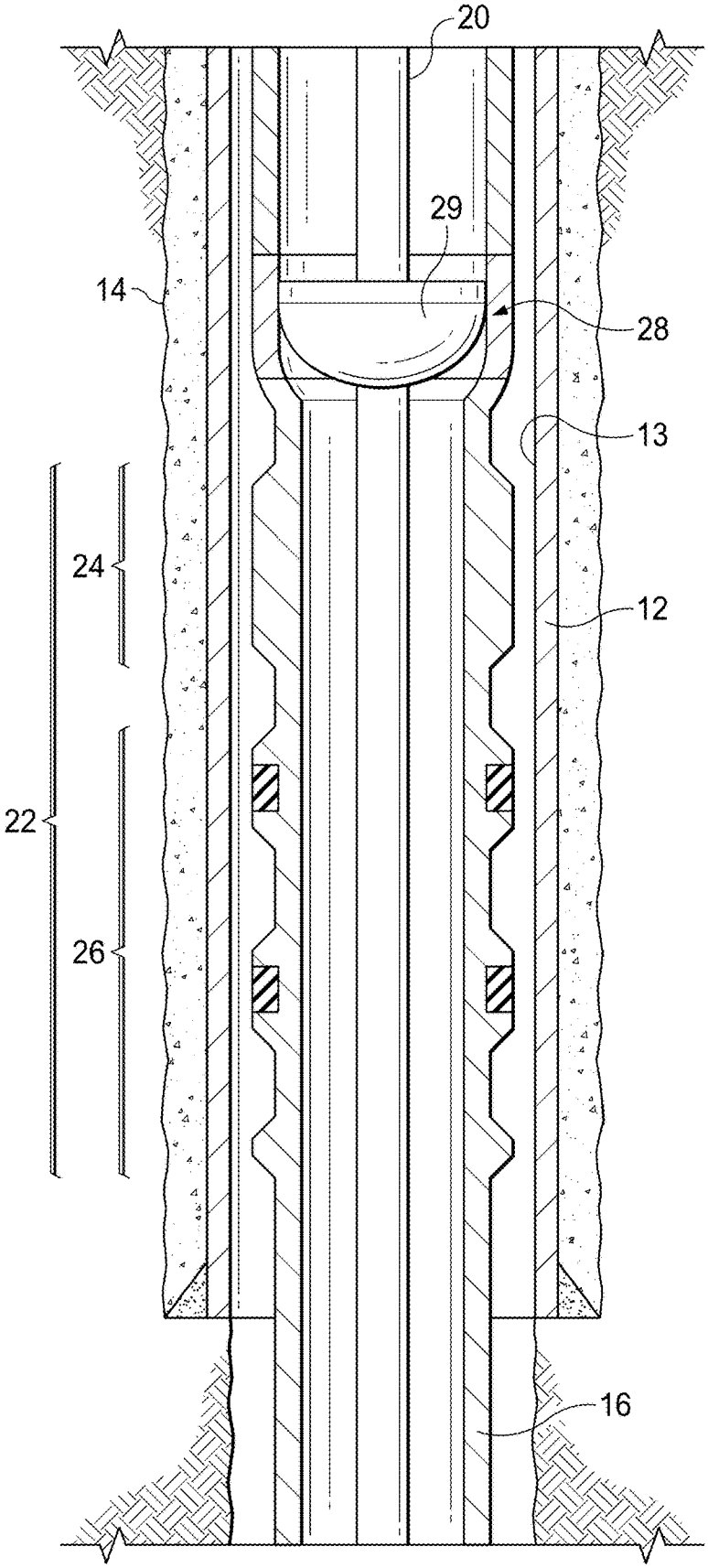
FIGS. 4A-4D illustrates a method of installation for a liner hanger setting system.
Figure 4B:
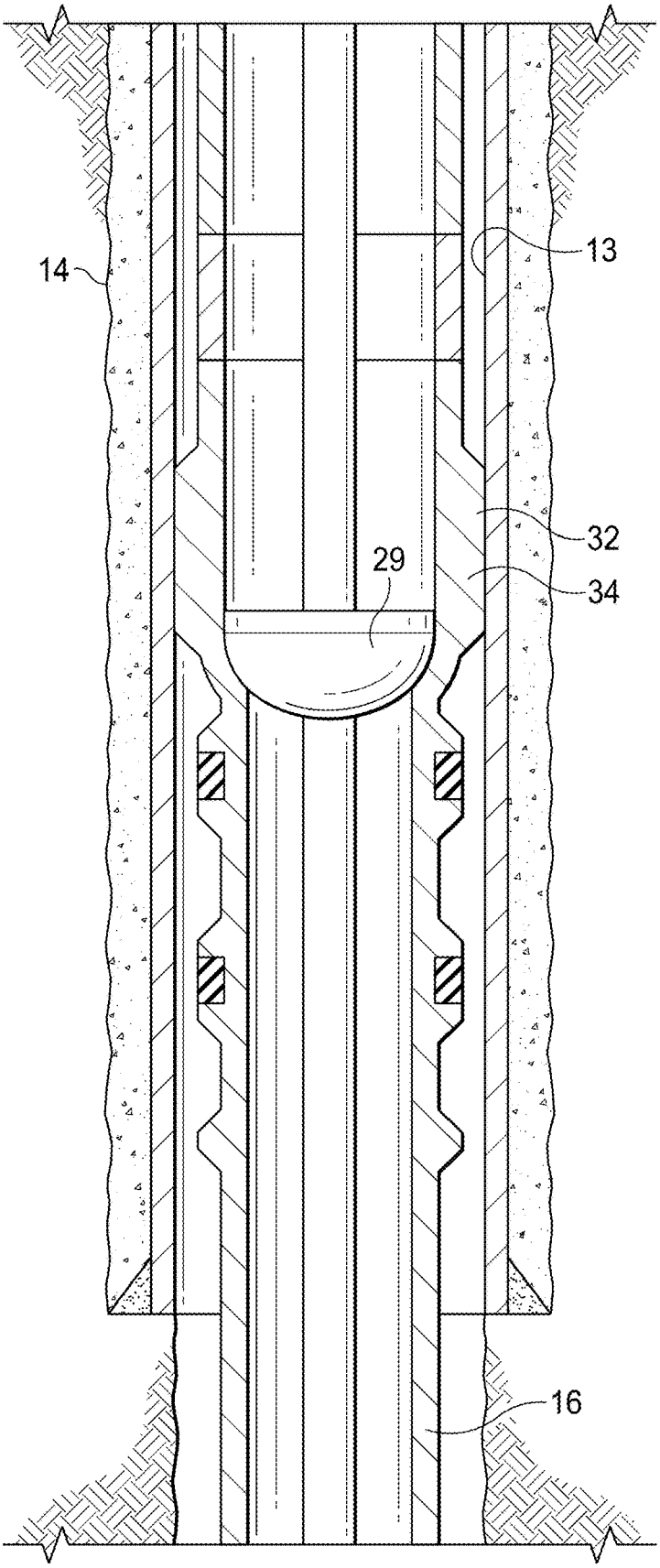

With reference to FIGS. 4A-4D, liner 16 and liner hanger assembly 22 may be relayed into wellbore 14 using work string 20 and setting tool 28. Once liner hanger assembly 22 is aligned with a target placement depth in wellbore 14, the installation process may proceed. Prior to commencing the installation process, expansion cone 29 of setting tool 28 may be located up hole from (i.e., above) both top section 24 and bottom section 26 of liner hanger assembly 22. At the widest point, the expansion cone 29 may be of a diameter such that, once it traverses the longitudinal extent of the radially expandable pipe body which contains top section 24 and bottom section 26, the exterior surface of the expandable pipe may be rendered flush with the inner surface of the tubular in which it is disposed (e.g., casing string 12 of FIG. 1). Therefore, it may be desirable to retain expansion cone 29 in a position that prevents even partial expansion of liner hanger assembly 22 until liner 16 and liner hanger assembly 22 are located at an acceptable location or depth for installation. During the installation process, top section 24 of liner hanger assembly 22 may be expanded prior to expanding bottom section 26 of liner hanger assembly 22. As depicted in FIG. 4B, progressing expansion cone 29 through the length of top section 24 of liner hanger assembly 22 may result in the radial expansion of top section 24 of liner hanger assembly 22. In some examples, inducing radial expansion in top section 24 of liner hanger assembly 22 involves pushing expansion cone 29 from a depth at or above top section 24 to a depth at or below top section 24. Anchoring ribs 32, which extend circumferentially around expandable tubular 34, may anchor into the inner surface 13 of casing string 12. This may affix top section 24 of liner hanger assembly 22 to casing string 12 which may secure the position of liner 16 and liner hanger assembly 22 in wellbore 14. Once expanded, top section 24 of liner hanger assembly 22 may at least partially support the axial load of liner 16 and liner hanger assembly 22 such that work string 20 and setting tool 28, along with expansion cone 29 may be removed from wellbore 14 in a process which may be known as "pulling out of hole," or "tripping out of hole."

Figure 4C:
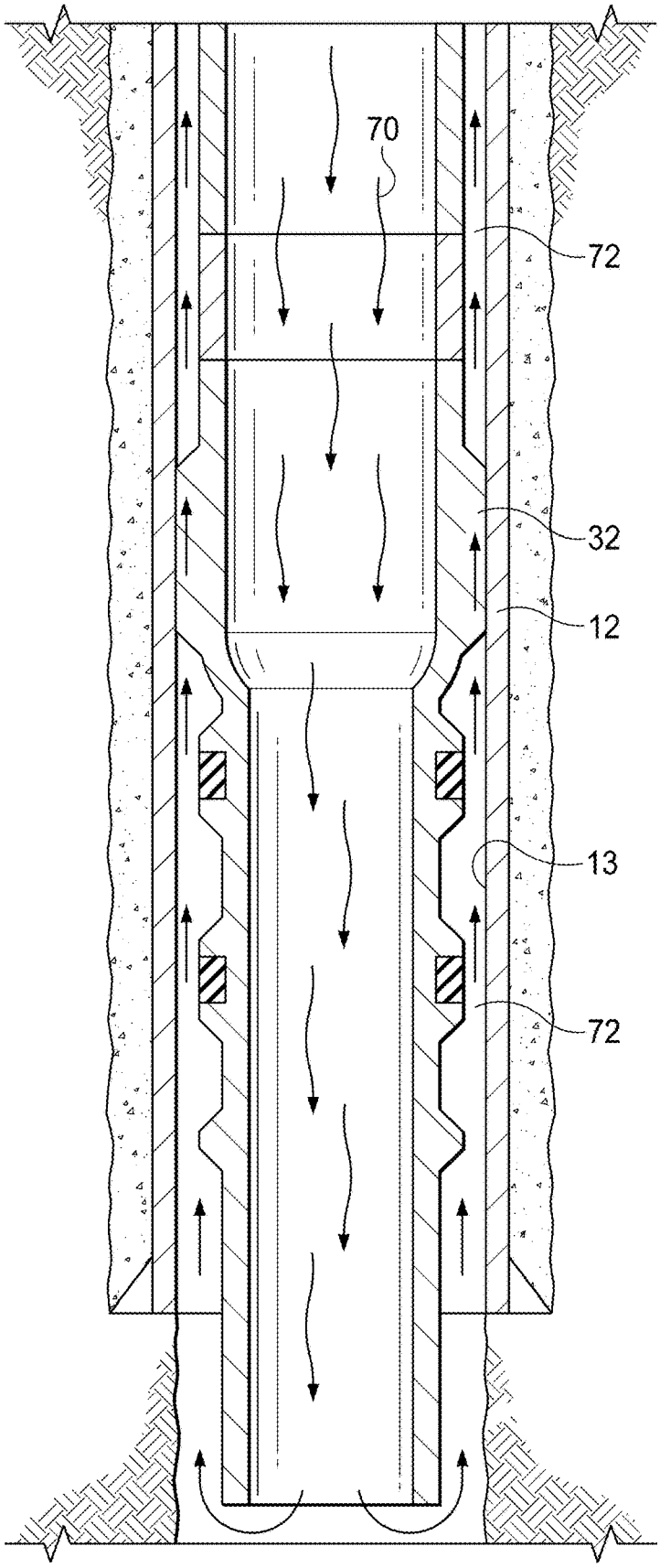
Figure 4D:
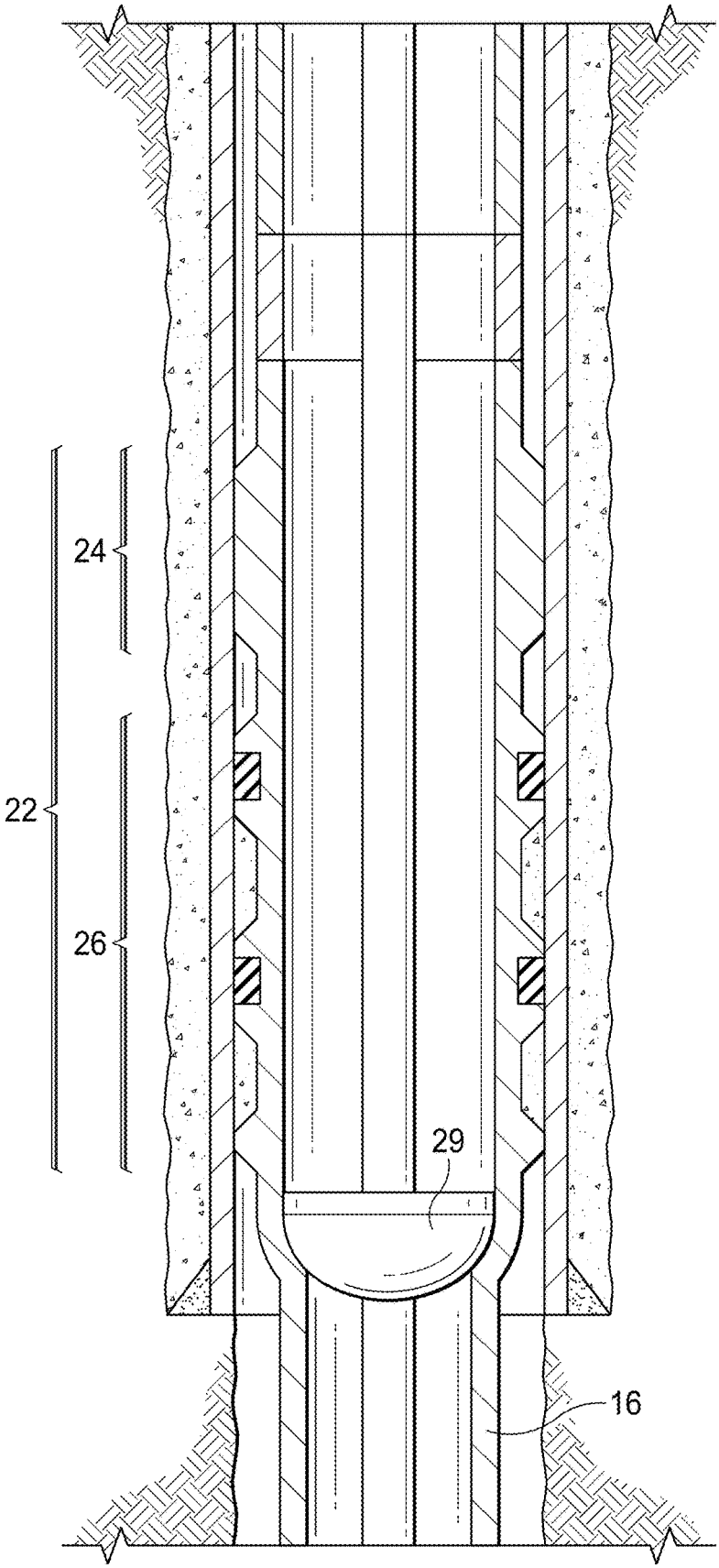

As depicted in FIG. 4C, cement may be pumped into the wellbore to provide annular isolation and seal off the annular space (e.g., annulus 18 of FIG. 1) that is formed between the inner surface 13 of casing string 12 and an external surface of liner hanger assembly 22 and liner 16. In some examples, the annular space may include the area between an outer surface of liner 16 a rockface of a subterranean formation which may be exposed during drilling, the area between the outer surface of liner hanger assembly 22 and the inner surface 13 of casing string 12, and/or the area between the outer surface of liner hanger assembly 22 and the inner surface of any other tubular which may be disposed in wellbore 14. The cement slurry 70 may be pumped down both the inner diameter of liner hanger assembly 22 and liner 16 before progressing into and up the annular space. The required volume of cement slurry 70 may be calculated or pre-determined in accordance with the diameter of the wellbore and the casing design. In some examples a spacer fluid (not shown) may be pumped ahead of and/or behind cement slurry 70. The spacer fluid may allow for both the proper placement of cement slurry 70 as well as preventing cement slurry 70 from contacting any displaced fluids which were utilized during the drilling process. While anchoring ribs 32, may be flush with the wall of inner surface 13 of casing string 12, the grooves (e.g., grooves 36, ring 38, and longitudinal groove 40 as depicted in FIG. 2C) may provide a conduit through which cement slurry 70 may flow. For example, flow path 72 depicts that cement slurry 70 may flow past top section 24 of liner hanger assembly 22. After cement slurry 70 has been placed in the annular space (e.g., annulus 18 of FIG. 1), setting tool 28 and expansion cone 29 may be returned to wellbore 14 in a process that may be known as "running in hole," or "tripping in hole." Prior to cementing, expansion cone 29 may only be utilized to only create radial expansion within upper section 24 of liner hanger assembly 22. After cementing, and as depicted in FIG. 4D, expansion cone 29 may be extended through the remainder of liner hanger assembly 22 thereby radially expanding lower section 26 of liner hanger assembly 22. Upon the expansion of lower section 26, anchoring ridges 60 and/or scaling members 62 may engage with the inner surface of casing string 12. In some examples, anchoring ridges 60 may form a metal-to-metal seal with the inner surface of casing string 12. In further examples, either a portion or all of liner 16, which is located downhole, or below the bottom of lower section 26 of liner hanger assembly 22 may be expanded. However, in some examples, only top section 24 and bottom section 26 of liner hanger assembly are radially expanded using expansion cone 29.

Figure 5A:
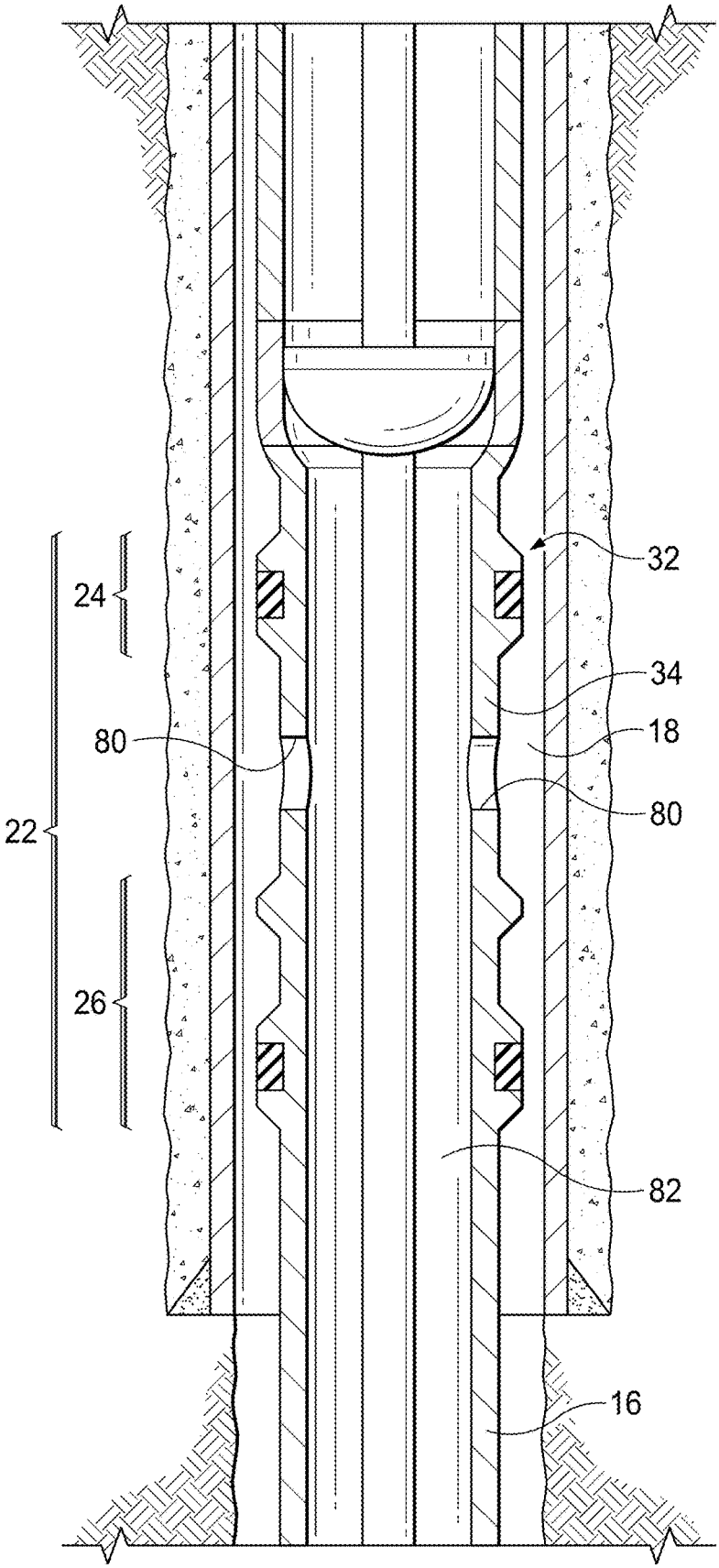
FIGS. 5A-5D illustrates an additional method of installation for a liner hanger setting system.

As depicted in FIG. 5A, liner hanger assembly 22 may include one or more fluid passageways 80 which may fluidically connect the internal portion 82 of liner hanger assembly 22 with annulus 18. While fluid passageways 80 may include any conduit that allows for the transport of fluid between internal portion 82 of liner hanger assembly 22 and annulus 18, some non-limiting examples may include perforations, ports, and/or slots. FIG. 5A may depict such fluid passageways 80 as being disposed in the body of expandable tubular 34 between upper section 24 and lower section 26 of liner hanger assembly 22.

Figure 5B:
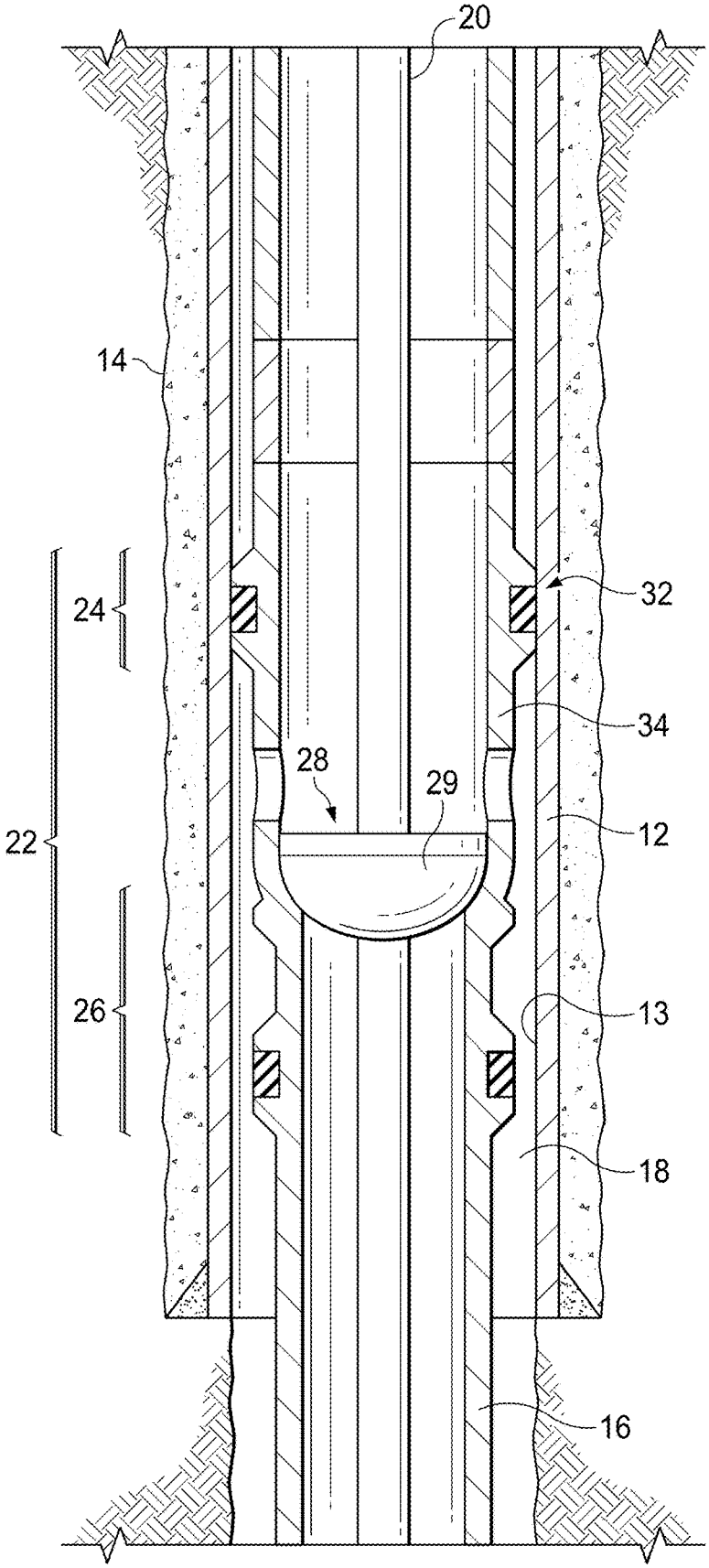

With reference to FIGS. 5A-5D, liner 16 and liner hanger assembly 22 may be relayed into wellbore 14 using work string 20 and setting tool 28. Once liner hanger assembly 22 is aligned with a target placement depth in wellbore 14, the installation process may proceed. Prior to commencing the installation process, expansion cone 29 of setting tool 28 may be located up hole from (i.e., above) both top section 24 and bottom section 26 of liner hanger assembly 22. At the widest point, expansion cone 29 may be of a diameter such that, once it traverses the longitudinal extent of the radially expandable pipe body (e.g., liner hanger assembly 22 and/or liner 16), the exterior surface of the expandable pipe may be rendered flush with the inner surface of the tubular in which it is disposed (e.g., casing string 12 of FIG. 1). Therefore, it may be desirable to retain expansion cone 29 in a position that prevents even partial expansion of liner hanger assembly 22 until liner 16 and liner hanger assembly 22 are located at an acceptable location or depth for installation. During the installation process, top section 24 of liner hanger assembly 22 may be expanded prior to expanding bottom section 26 of liner hanger assembly 22. In some examples, fluid passageways 80 may be disposed between top section 24 and bottom section 26 of liner hanger assembly 22. As depicted in FIG. 5B, the progression of expansion cone 29 through top section 24 of liner hanger assembly 22 may result in the radial expansion of top section 24 of liner hanger assembly 22. In some examples, the radial expansion of top section 24 of liner hanger assembly 22 may include progressing expansion cone 29 beyond the depth at which flow passageways 80 are located. In further examples, the radial expansion of expandable tubular 34 for top section 24 of liner hanger assembly 22 includes expanding the portion of expandable tubular 34 on which fluid passageways 80 are disposed. Anchoring ribs 32, which extend circumferentially around expandable tubular 34, may anchor into the inner surface 13 of casing string 12. This may affix top section 24 of liner hanger assembly 22 to casing string 12 which may secure the position of liner 16 and liner hanger assembly 22 in wellbore 14. In the radially expanded position, top section 24 of liner hanger assembly 22 may at least partially support the axial load of liner 16 and liner hanger assembly 22.

Figure 5C:
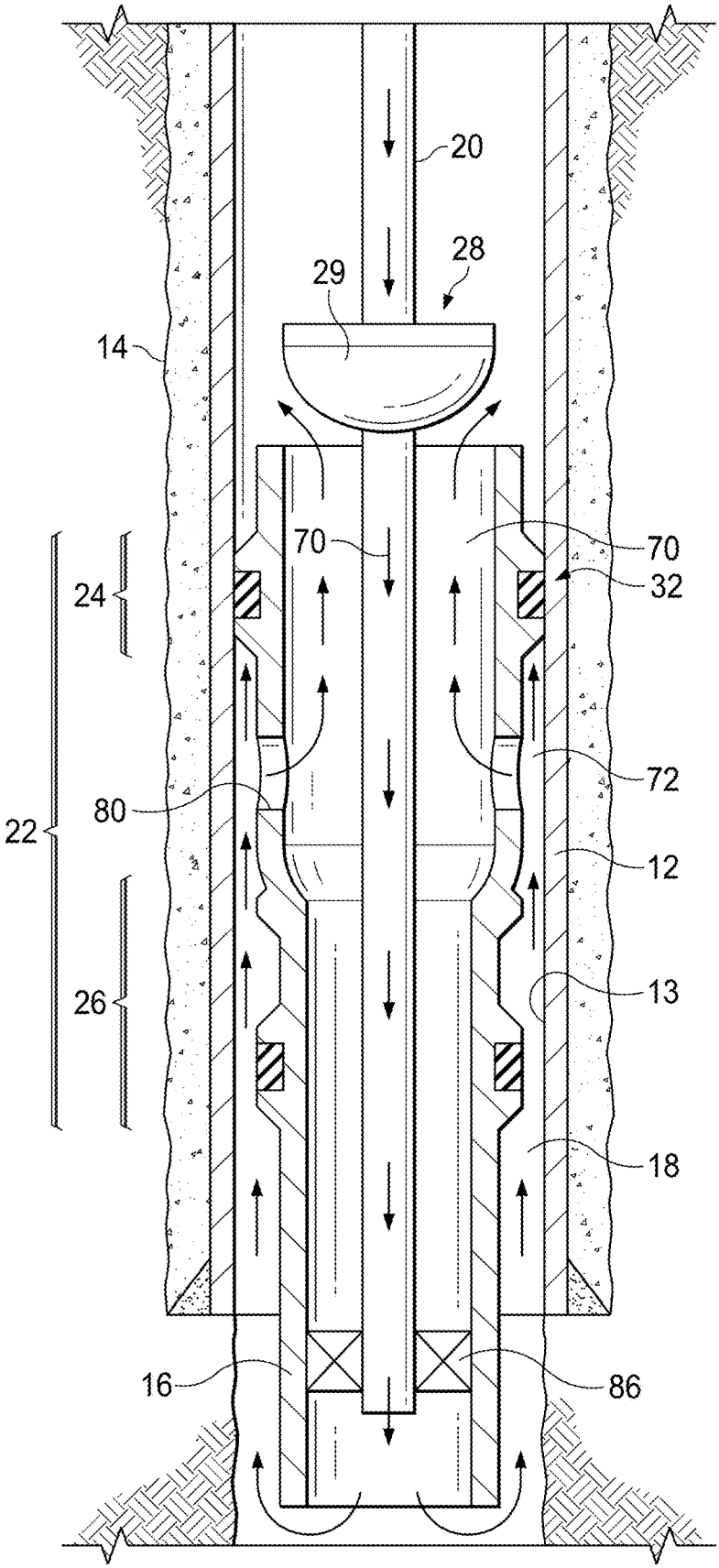
Figure 5D:
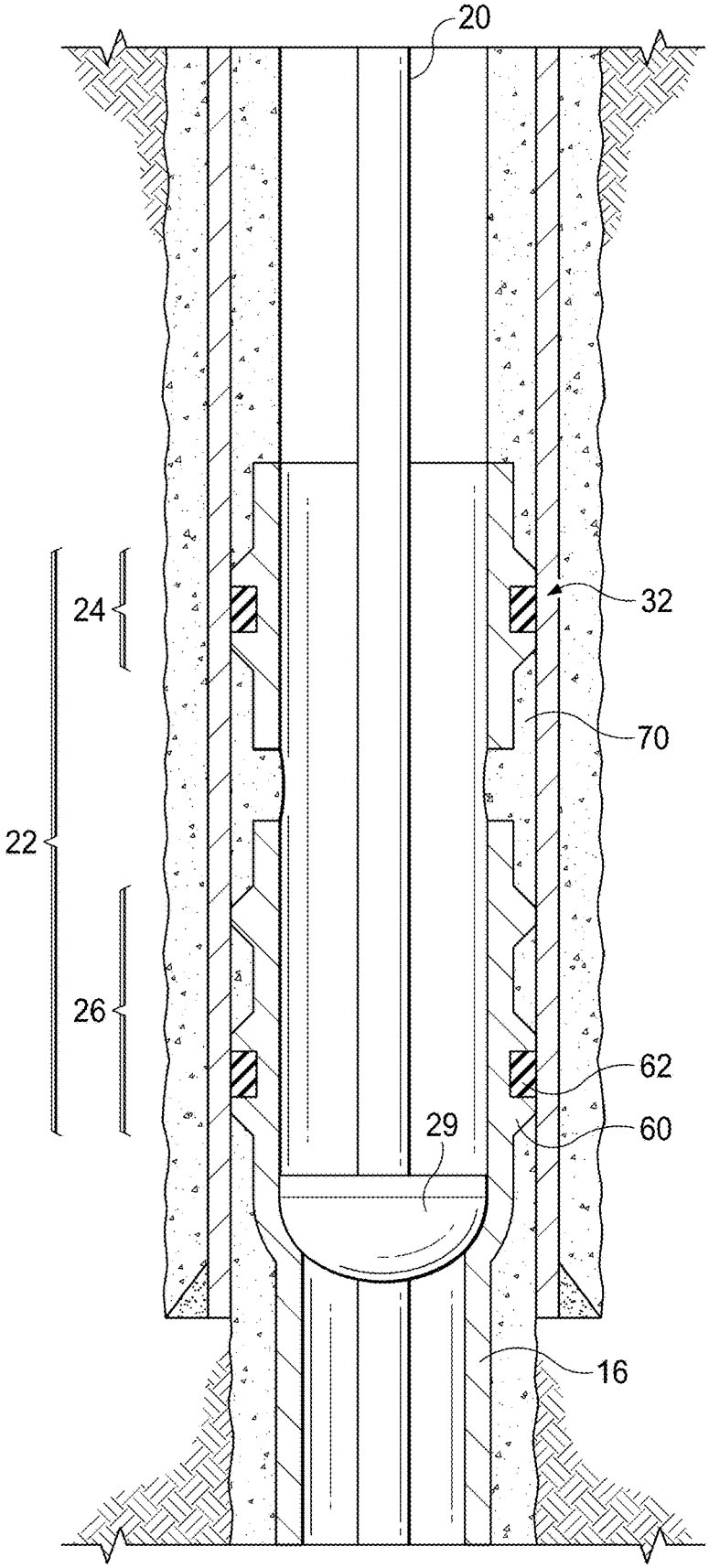

As depicted in FIG. 5C, cement may be pumped into the wellbore to provide annular isolation and seal off the annular space (e.g., annulus 18 of FIG. 1) that is formed between the inner surface 13 of casing string 12 and an external surface of liner hanger assembly 22 and liner 16. In some examples, the annular space may include the area between an outer surface of liner 16 a rockface of a subterranean formation which may be exposed during drilling, the area between the outer surface of liner hanger assembly 22 and the inner surface 13 of casing string 12, and/or the area between the outer surface of liner hanger assembly 22 and the inner surface of any other tubular which may be disposed in wellbore 14. The cement slurry 70 may be pumped down the inner diameter of work string 20 before progressing into and up the annular space (e.g., annulus 18 of FIG. 1). An isolation packer 86 may be engaged with the inner surface of liner 16 to ensure that cement slurry 70 progresses up annulus 18 rather than entering the annular space created between the outer surface of work string 20 and the inner surface of liner 16. In some examples a spacer fluid (not shown) may be pumped ahead of and/or behind cement slurry 70. The spacer fluid may allow for both the proper placement of cement slurry 70 as well as preventing cement slurry 70 from contacting any displaced fluids which were utilized during the drilling process. As illustrated in FIG. 5C, a space fluid and/or cement slurry 70 may progress through fluid passageways 80 once they have progressed up the length of the annular space (e.g., annulus 18 in FIG. 1). The required volume of cement slurry 70 may be calculated or pre-determined in accordance with the diameter of the wellbore and the casing design. While anchoring ribs 32, may be flush with the wall of wellbore 14, the grooves (e.g., grooves 36, ring 38, and longitudinal groove 40 as depicted in FIG. 2C) may provide a conduit through which cement slurry 70 may flow. For example, flow path 72 depicts that cement slurry 70 may flow through the annular space of the top section 24 of liner hanger assembly 22. After cement slurry 70 has been placed in the annular space (e.g., annulus 18 of FIG. 1), setting tool 28 and expansion cone 29 may be returned to wellbore 14 in a process that may be known as "running in hole," or "tripping in hole." Prior to cementing, expansion cone 29 was utilized to only create radial expansion within upper section 24 of liner hanger assembly 22. After cementing, and as depicted in FIG. 5D, expansion cone 29 may be extended through the remainder of liner hanger assembly 22 thereby radially expanding lower section 26 of liner hanger assembly 22. Upon the expansion of lower section 26, anchoring ridges 60 and/or sealing members 62 may engage with the inner surface of casing string 12. In some examples, anchoring ridges 60 may form a metal-to-metal seal with the inner surface of casing string 12. Due to the flow paths created by grooves 36 located between the anchoring ribs 32 in upper section 24 of liner hanger assembly 22, cement slurry 70 may be disposed in the annular space (e.g., annulus 18 in FIG. 1) between the exterior surface of upper section 24 and the inner surface of the wellbore wall. In some examples, either a portion or all of liner 16, which is located downhole, or below the bottom of lower section 26 of liner hanger assembly 22 may be expanded. However, in some examples, only top section 24 and bottom section 26 of liner hanger assembly are radially expanded using expansion cone 29.

Accordingly, the systems and methods of the present disclosure allow for improvements over the current technology comprising increased cement coverage over the length of an expandable liner hanger. In some examples, the improvements may provide for full cement coverage across the length of an expandable liner hanger. The methods may include any of the various features disclosed herein, including one or more of the following statements.

Statement 1. A method comprises expanding a first section of an expandable tubular comprising the first section and a second section, wherein the first section comprises one or more anchoring ribs; and expanding the second section of the expandable tubular after cement is pumped into the expandable tubular.

Statement 2. The method of statement 1, wherein the expandable tubular is disposed in a wellbore.

Statement 3. The method of any of the foregoing statements, wherein the first section of the expandable tubular is expanded with a setting tool.

Statement 4. The method of any of the foregoing statements, wherein the second section of the expandable tubular is expanded with the setting tool.

Statement 5. The method of any of the foregoing statements, wherein expanding the first section of the expandable tubular further comprises disposing a setting tool in a wellbore and extending the setting tool through the first section of the expandable tubular.

Statement 6. The method of any of the foregoing statements, further comprising removing the setting tool from the wellbore before the cement is pumped into the expandable tubular.

Statement 7. The method of any of the foregoing statements, wherein the cement is pumped through the expandable tubular while the setting tool is disposed in the wellbore.

Statement 8. The method of any of the foregoing statements, wherein a fluid passageway is disposed between the first section and the second section.

Statement 9. The method of any of the foregoing statements, further comprising allowing cement to flow through the fluid passageway.

Statement 10. The method of any of the foregoing statements, wherein the second section of the expandable tubular further comprises one or more anchoring ridges, sealing members, or combinations thereof.

Statement 11. The method of any of the foregoing statements, wherein the second section is configured to create a metal-to-metal seal with the interior surface of a tubular.

Statement 12. A two-stage expandable liner hanger, comprising a first tubular portion of a liner hanger positionable inside a casing in a wellbore and having a first set of engagement members on an exterior surface, the first tubular portion being expandable for engagement of the first set of engagement members with the casing; and a second tubular portion of the liner hanger coupled to the first tubular portion and having a second set of engagement members on an exterior surface having a different configuration than the first set of engagement members, the second tubular portion being expandable independently of the first tubular portion for engagement of the second set of engagement members with the casing.

Statement 13. The two-stage expandable liner hanger of statement 12, wherein the first set of engagement members comprise anchoring members configured for biting engagement with the casing upon expansion of the first tubular portion and providing sufficient radial spacing between the first tubular portion and the casing to allow fluid flow after the expansion.

Statement 14. The two-stage expandable liner hanger of statements 12 or 13, wherein the second set of engagement members frictionally engage and circumferentially seal the casing upon expansion of the second tubular portion.

Statement 15. The two-stage expandable liner hanger of any one of the statements 12-14, wherein the anchoring members comprise vertical or helical anchoring ribs.

Statement 16. The two-stage expandable liner hanger of statement 15, wherein the vertical or helical anchoring ribs are segmented.

Statement 17. The two-stage expandable liner hanger of statement 16, wherein the segmented vertical or helical anchoring ribs have a castellated arrangement on the exterior of the first tubular portion.

Statement 18. The two-stage expandable liner hanger of claim 17, wherein the anchoring pattern is a staggered castellated anchoring pattern.

Statement 19. The expandable liner hanger of any one of the statements 12-18, further comprising a plurality of fluid passageways through a wall of the liner hanger between the first portion and the second portion providing fluid communication between an interior of the liner hanger and an annulus between the liner hanger and the casing in where the liner hanger is disposed after expansion of at least the first tubular portion.

Statement 20. The two-stage expandable liner hanger of any one of the statements 12-19, further comprising a setting tool configured for independently expanding the first tubular section prior to cementing followed by the second tubular section after cementing.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A method comprising:

conveying a setting tool, a liner hanger, and a liner, into a wellbore via a work string, wherein the setting tool is disposed uphole from a first section of the liner hanger, and wherein the liner hanger comprises:

the first section of the liner hanger positionable inside a casing in the wellbore, wherein the first section has a plurality of vertical anchoring ribs extending radially outward from an exterior surface of the first section, wherein the plurality of vertical anchoring ribs are disposed about the first section to form one or more longitudinal grooves configured to provide respective flow conduits for cement during cementing operations with the first section in an expanded position, wherein the first section is configured to expand, via the setting tool, to drive the plurality of vertical anchoring ribs into a biting engagement with the casing; and a second section of the liner hanger coupled to the first section, wherein the second section has one or more sealing members disposed on an exterior surface of the second section, wherein the one or more sealing members are configured to engage and circumferentially seal the second section against the casing in response to expansion of the second section, wherein the second section is expandable, via the setting tool, independently of the first section;

expanding the first section of the liner hanger with an expansion cone of the setting tool;

cementing the liner hanger, wherein cement is configured to flow between the liner hanger and the casing through the one or more longitudinal grooves formed between the plurality of vertical anchoring ribs; and expanding the second section of the liner hanger with the expansion cone after cement is pumped into the liner hanger.

2. The method of claim 1, wherein the expandable tubular is disposed in the wellbore.

3. The method of claim 1, wherein expanding the first section of the expandable tubular further comprises disposing the setting tool in the wellbore and extending the setting tool through the first section of the expandable tubular.

4. The method of claim 3, further comprising removing the setting tool from the wellbore before the cement is pumped into the expandable tubular.

5. The method of claim 3, wherein the cement is pumped through the expandable tubular while the setting tool is disposed in the wellbore.

6. The method of claim 1, wherein a fluid passageway is disposed between the first section and the second section.

7. The method of claim 6, further comprising allowing cement to flow through the fluid passageway.

8. The method of claim 1, wherein the second section is configured to create a metal-to-metal seal with an interior surface of a casing of the wellbore.

9. A method comprising:

expanding a first section of an expandable tubular of a liner hanger assembly, with a setting tool, into an engagement with a casing of a wellbore, wherein the expandable tubular comprises the first section and a second section, wherein the first section is positioned inside the casing, wherein the first section comprises one or more vertical anchoring ribs extending radially outward from an exterior surface of the first section, wherein the plurality of vertical anchoring ribs are disposed about the first section to form one or more longitudinal grooves configured to provide respective flow conduits for cement during cementing operations with the first section in an expanded position wherein the first section is configured to expand, via the setting tool to drive the plurality of vertical anchoring ribs into the engagement with the casing; and expanding the second section of the expandable tubular with the setting tool after cement is pumped into the expandable tubular, wherein the second section of the expandable tubular further comprises one or more sealing members disposed on an exterior surface of the second section wherein the one or more sealing members are configured to engage and circumferentially seal the second section against the casing of the wellbore in response to expansion of the second section, and wherein the second section is expandable, via the setting tool independently of the first section.

10. The method of claim 9, further comprising conveying the setting tool, the liner hanger assembly, and a liner, into the wellbore via a work string, wherein the setting tool is disposed uphole from the first section of the expandable tubular of the liner hanger assembly.

11. The method of claim 9, wherein expanding the first section of the expandable tubular further comprises disposing the setting tool in the wellbore and extending the setting tool through the first section of the expandable tubular.

12. The method of claim 11, further comprising removing the setting tool from the wellbore before the cement is pumped into the expandable tubular.

13. The method of claim 11, wherein the cement is pumped through the expandable tubular while the setting tool is disposed in the wellbore.

14. The method of claim 9, wherein a fluid passageway is disposed between the first section and the second section, further comprising allowing the cement to flow through the fluid passageway.

15. The method of claim 9, wherein the first section includes an upper section of the expandable tubular, and wherein the second section includes a lower section of the expandable tubular.

16. The method of claim 9, wherein the second section is configured to create a metal-to-metal seal with an interior surface of the casing of the wellbore.

17. The method of claim 9, wherein the engagement between the one or more vertical anchoring ribs and the casing is configured to maintain a radial gap between an exterior surface of the first section and the casing to allow fluid flow through the longitudinal grooves with the first section in the expanded position.

* * * * *